US009566531B2

(12) United States Patent
Hacking

(10) Patent No.: US 9,566,531 B2
(45) Date of Patent: Feb. 14, 2017

(54) ACTION CHARACTER MODELS AND ACCESSORIES WITH MOVABLE PARTS

(71) Applicant: Morphonauts LLC, Lehi, UT (US)

(72) Inventor: Beau Jared Hacking, Lehi, UT (US)

(73) Assignee: Morphonauts LLC, Lehi, UT (US)

( * ) Notice: Subject to any disclaimer, the term of this patent is extended or adjusted under 35 U.S.C. 154(b) by 0 days.

(21) Appl. No.: 14/796,806

(22) Filed: Jul. 10, 2015

(65) Prior Publication Data

US 2016/0008728 A1 Jan. 14, 2016

Related U.S. Application Data

(60) Provisional application No. 62/022,949, filed on Jul. 10, 2014.

(51) Int. Cl.

| | |
|---|---|
| ***A63H 3/46*** | (2006.01) |
| ***A63H 33/26*** | (2006.01) |
| ***A63H 3/16*** | (2006.01) |

(52) U.S. Cl.

CPC *A63H 3/46* (2013.01); *A63H 3/16* (2013.01); *A63H 33/26* (2013.01)

(58) Field of Classification Search

CPC ..... A63H 33/00; A63H 33/04; A63H 33/12; A63H 33/26; A63H 33/046; A63H 3/00; A63H 3/46; A63H 3/52; A63H 3/365

USPC ..... 446/92, 97, 99, 102, 137, 139, 321, 376

See application file for complete search history.

(56) References Cited

U.S. PATENT DOCUMENTS

| | | | | |
|---|---|---|---|---|
| 3,090,155 A * | 5/1963 | Gordon | A63H 33/26 428/900 |
| 3,168,227 A | 2/1965 | Osmond | |
| 3,246,422 A | 4/1966 | Teagarden | |
| 4,118,888 A * | 10/1978 | Ogawa | A63H 33/26 124/16 |
| 5,746,638 A * | 5/1998 | Shiraishi | A63H 33/046 446/131 |
| 8,062,088 B2 * | 11/2011 | Perry | A63H 33/046 446/101 |

(Continued)

FOREIGN PATENT DOCUMENTS

| | | |
|---|---|---|
| EP | 1 500 417 A1 | 1/2005 |
| WO | 2004/018064 A1 | 3/2004 |

OTHER PUBLICATIONS

Partial International Search Report dated Oct. 19, 2015, issued in PCT Application No. PCT/US2015/040007, filed Jul. 10, 2015.

*Primary Examiner* — Kien Nguyen
(74) *Attorney, Agent, or Firm* — Workman Nydegger

(57) ABSTRACT

An action character model includes a torso and a plurality of appendages including a head and at least one arm and one leg. A plurality of first magnets are attached to and project out of one of the torso or the plurality of appendages. A plurality of second magnets are disposed within the other of the torso or the plurality of appendages on which the first magnets are not attached. The other of the torso or plurality of appendages each bound a recessed socket extending from an exterior surface of the corresponding torso or appendage toward a corresponding one of the second magnets, each of the first magnets being at least partially received within a corresponding recessed socket so that each appendage is magnetically coupled with the torso and so that each appendage is rotatable on the torso.

21 Claims, 15 Drawing Sheets

(56) References Cited

U.S. PATENT DOCUMENTS 8,888,553 B2 * 11/2014 McMullen ..... A63H 3/365
446/321

* cited by examiner

ACTION CHARACTER MODELS AND ACCESSORIES WITH MOVABLE PARTS

CROSS-REFERENCE TO RELATED APPLICATIONS

This application claims benefit to U.S. Provisional Application No. 62/022,949, filed Jul. 10, 2014, which is incorporated herein by specific reference.

BACKGROUND OF THE INVENTION

1. The Field of the Invention

The present invention relates to toy action character assemblies having movable and removable parts and appendages.

2. The Relevant Technology

Toy action characters come in a variety of different configurations and are commonly acquired by youth for collection and play. Many toy action characters are fixed in their design so that no modifications can be made thereto. Such designs permit limited creativity and restrict the ability to adapt the characters to different situations. Other action characters can permit the addition of accessories. Such modifications, however, are typically limited and often incorporate delectate connectors that are easily broken.

Accordingly, what is needed in the art are toy action characters that can be easily and dramatically modified to improve creativity and allow for adaptation of the character to different situations. Furthermore, such toy action characters are needed where the toys are sturdy and the connections between parts is strong so that there is no unintentional separation or failure.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
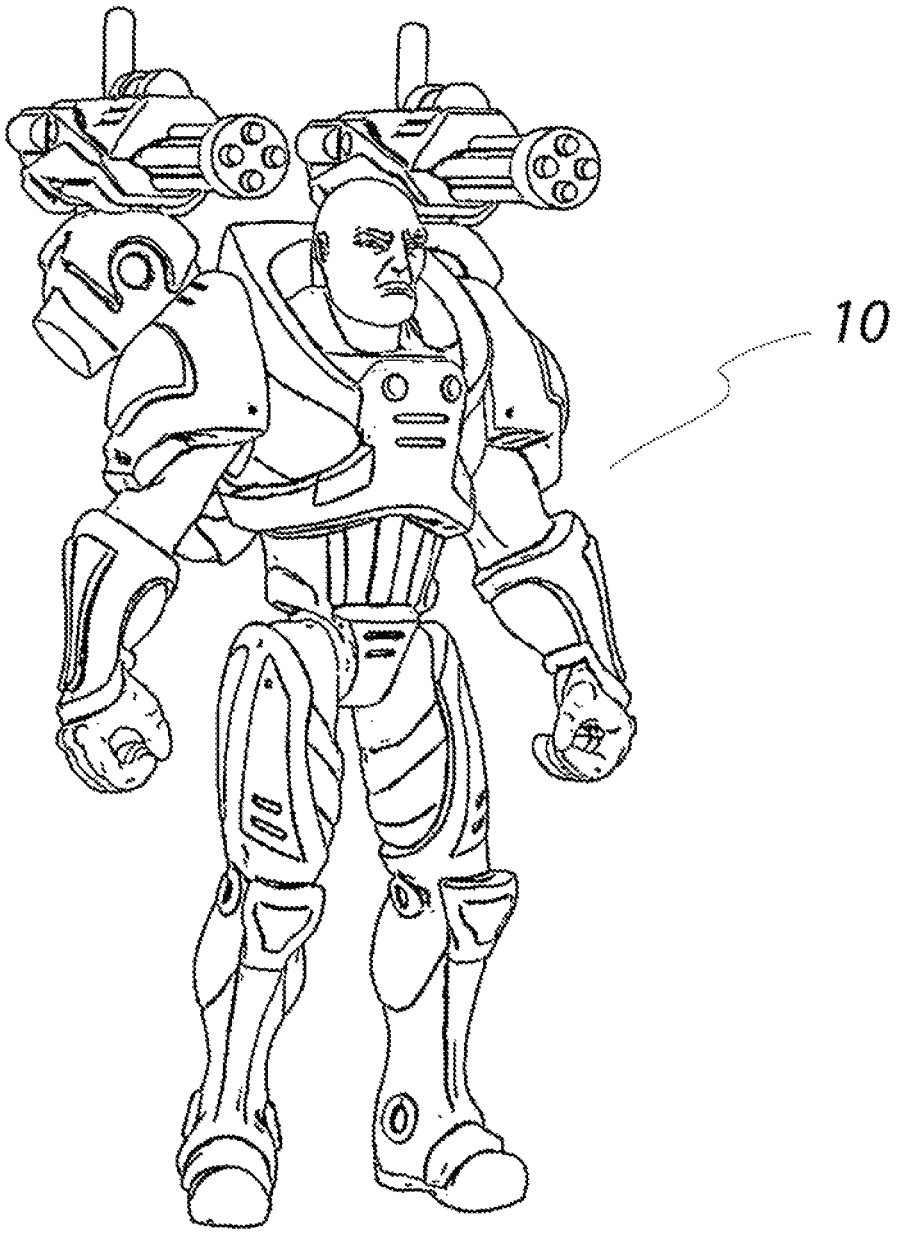
FIG. 1 is a perspective view of a toy action character model.

In the following detailed description, reference is made to the accompanying drawings, which form a part hereof. In the drawings, similar symbols typically identify similar components, unless context dictates otherwise. The embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein. It will also be understood that any reference to a first, second, etc. element in the claims or in the detailed description is not meant to imply numerical sequence, but is meant to distinguish one element from another unless explicitly noted otherwise.

In addition, as used in the specification and appended claims, directional terms, such as "top," "bottom," "up," "down," "upper," "lower," "proximal," "distal," "horizontal," "vertical," and the like are used herein solely to indicate relative directions and are not otherwise intended to limit the scope of the invention or claims.

In the drawings, like numerals designate like elements. Furthermore, multiple instances of an element may each include separate letters appended to the element number. For example two instances of a particular element "20" may be labeled as "20*a*" and "20*b*". In that case, the element label may be used without an appended letter (e.g., "20") to generally refer to every instance of the element; while the element label will include an appended letter (e.g., "20*a*") to refer to a specific instance of the element.

Figure 2:
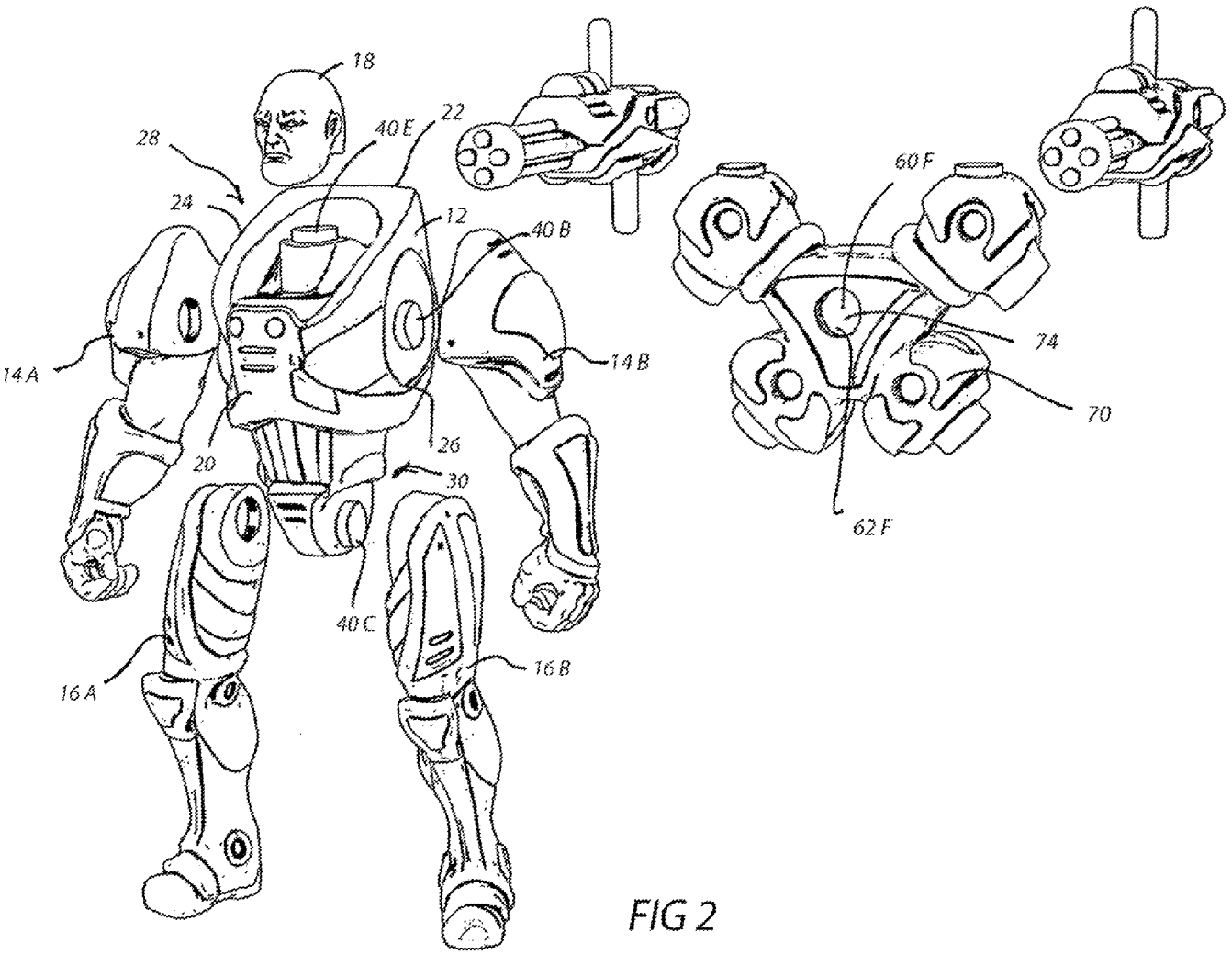
FIG. 2 is an exploded view of the toy action character model shown in FIG. 1.

Depicted in FIG. 1 is one embodiment of an inventive toy action character model 10 incorporating features of the present invention. As depicted in FIG. 2, action character model 10 comprises a torso 12 having a plurality of appendages and accessories that are removably attach thereto. In the embodiment depicted, the appendages can comprise a right arm 14A, a left arm 14B, a right leg 16A, a left leg 16B, and a head 18. As will be discussed below in more detail, it is appreciated that torso 12, arms 14, legs 16, and head 18 can come in a variety of different sizes and configurations and that different accessories can be matched with different torsos to produce action characters 10 having a variety of different configurations. Furthermore, different torsos can be configured to have different numbers and types of appendages that attach thereto. For example, a torso can be configured to attach to one, two, three, four, or six or more appendages to form different appearances and different creatures. The torso, appendages and accessories are typically molded from a plastic or polymer material, such as through injection molding or other molding processes. Other materials and methods of manufacture can also be used. The fully assembled action characters 10 typically have a maximum length in a range between about 5 cm to about 50 cm with about 8 cm and 18 cm being more common. Other dimensions can also be used.

Action character model 10 is configured so that the appendages can be moveable attached to torso 12 and be selectively removable from torso 12. For example, torso 12 comprises a front face 20, an opposing back face 22, a right side 24, and an opposing left side 26 that all extend between an upper end 28 and an opposing lower end 30. Upper end terminates at a top face 29. As better depicted in FIG. 3, openings 32A and 32B are formed on sides 24 and 26, respectively, of torso 12 at upper end 28. Similarly, openings 34A and 34B are formed on opposing sides 24 and 26, respectively, of torso 12 at lower end 30. An opening 36 is also centrally formed on top face 29. In the depicted embodiment, openings 32-36 comprise circular recesses in the form of blind cylindrical sockets. Each opening 32-36 typically has a depth D1 extending from an exterior surface of torso 12 to an inside face 37 that is typically in a range between about 0.1 cm to about 0.5 cm. In other embodiments, the depth of D1 can be greater than, equal to, or less than 0.1 cm, 0.3 cm, 0.5 cm, 0.7 cm or 1 cm or in a range between any two of foregoing. Other dimensions can also be used.

Figure 4:
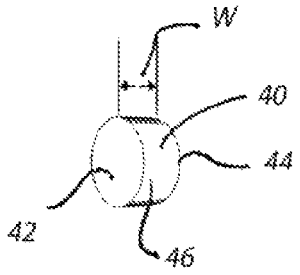
FIG. 4 is a perspective view of a magnet used in the toy action character model shown in FIG. 1.

Each opening 32-36 is configured to receive a first magnet 40. In one embodiment, as depicted in FIG. 4, each first magnet 40 is a disc magnet having a cylindrical configuration that includes a first end face 42 and an opposing second end face 44 that are typically both flat, disposed in parallel alignment, and have opposite poles. A circular sidewall 46 extends between end faces 42 and 44. The width W of first magnet 40 extending between faces 42 and 44 is typically greater than the diameter thereof. In one embodiment, each first magnet 40 has a diameter in a range between about 0.3 cm and about 1.5 cm with about 0.1 cm to about 1 cm being more common and has a width W in a range between about 0.2 cm and about 1 cm with about 0.2 cm to about 0.5 cm being more common. In other embodiments, the diameter of first magnet 40 can be greater than, equal to, or less than 0.1 cm, 0.3 cm, 0.5 cm, 0.7 cm, 1 cm or 1.5 cm or in a range between any two of foregoing while the width W can be greater than, equal to, or less than 0.1 cm, 0.3 cm, 0.5 cm, 0.7 cm, 1 cm or 1.5 cm or in a range between any two of foregoing with the width typically being greater than the diameter but not required. Other dimensions can also be used.

Figure 5:
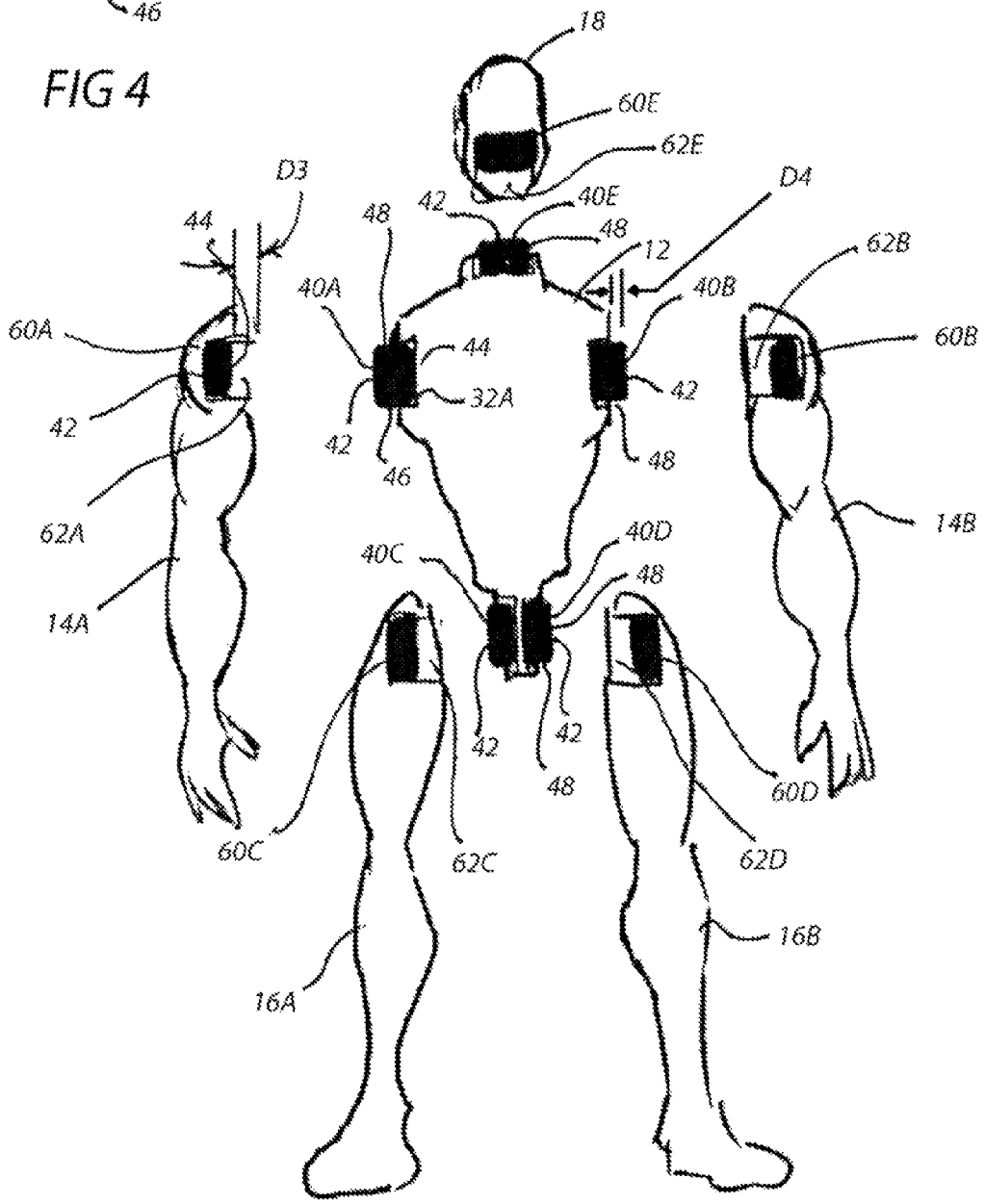
FIG. 5 is the schematic view shown in FIG. 3 showing the magnet in FIG. 4 within the openings on the torso and appendages.

As depicted in FIG. 5, a separate first magnet 40A-40E is received and secured within a corresponding one of openings 32-36. First magnets 40 and openings 32-36 can be of complementary diameter and first magnets 40 can be secured within opening 32-36 by an adhesive, welding, press-fit, over-molding, or using other conventional techniques. In one embodiment, width W of first magnets 40 is greater than the depth D1 of openings 32-36 in which they are received. Accordingly, when first magnets 40A-E are received within openings 32-36, end face 44 is disposed within openings 32-36, end face 42 is openly exposed outside of openings 32-36, and a cylindrical engaging portion 48 (comprising a portion of side wall 46) outwardly projects from the exterior surface of torso 12. The width of engaging portion 48 extending from the exterior surface of torso 12 to end face 42, i.e., distance D4, is typically in a range between about 0.1 cm and about 0.5 cm, although other dimensions can also be used. In other embodiments, the width of engaging portion 48 can be greater than, equal to, or less than 0.1 cm, 0.3 cm, 0.5 cm, or 0.7 cm, or in a range between any two of foregoing.

Magnets 40 can be made of a variety of different materials. Examples of magnets that can be used include neodymium disc and cylinder rare earth magnets. Other materials and types of magnets can also be used. Magnets 40 are typically high strength magnets having a pull force of at least 2 pounds (0.9 kilograms (kg)), 2.5 pounds (1.1 kg), 3 pounds (1.4 kg), 3.5 pounds (1.6 kg), 4 pounds (1.4 kg) or 4.5 pounds (2.0 kg) or in a range between any two of the foregoing. Other strengths can also be used. The pull force can be measured as the pull force needed to remove a magnet 40 from a thick, ground, flat steel plate as is known in the art.

Engaging portion 48 of first magnets 40 are used for attaching the appendages 14-18 to torso 12. Specifically, returning to FIG. 3, each appendage 14-18 also has an opening formed thereon. For example, arms 14A and B have openings 52A and B formed thereon; legs 16A and B have openings 54A and B formed thereon; and head 18 has an opening 56 formed thereon. Openings 52-56 are also circular recesses that form cylindrical blind sockets having a depth D2 extending from an exterior surface of each appendage 14-18 to an inside face 58. Openings 52-56 have a size and configuration similar to openings 32-36 except that the depth D2 of openings 52-56 is typically greater than the depth D1 of openings 32-36 by an amount in a range between 0.1 cm and 0.5 cm. Other dimensions can also be used. In other embodiments, the depth D2 can be greater than the depth D1 by an amount greater than, equal to, or less than 0.1 cm, 0.3 cm, 0.5 cm or 0.7 cm or in a range between any two of foregoing. The depth of D2 can be greater than, equal to, or less than 0.1 cm, 0.3 cm, 0.5 cm, 0.7 cm, 1 cm or 1.5 cm or in a range between any two of foregoing.

As depicted in FIG. 5, second magnets 60A-E are disposed within corresponding openings 52-56. Second magnets 60 can also be disc magnets and can have the same size, configuration, pull force, composition, and other properties as first magnets 40 as discussed above. As such, like elements between first magnets 40 and second magnets 60 are identified by like reference characters. Second magnets 60A-E are positioned within openings 52-56 so that second end face 44 is openly exposed within openings 52-56. End face 42 of first magnets 40 and end face 44 of second magnets 60 are of opposite pole so that they magnetically attract each other. Second magnets 60A-E can be secured within openings 52-56 using the same technique used to secure first magnets 40 within openings 32-36 as discussed above. Because of the increased depth D2 of openings 52-56, when second magnets 60 are fully received and secured within openings 52-56, as shown in FIG. 5, a recessed socket 62A-E is formed extending from end face 44 of second magnets 60A-E to the exterior surface of the corresponding appendage 14-18. Recessed sockets 62A-E typically have a depth D3 in a range between about 0.1 cm to about 0.5 cm but other dimensions can also be used. In other embodiments, the depth of D3 can be greater than, equal to, or less than 0.1 cm, 0.3 cm, 0.5 cm, 0.7 cm or 1 cm or in a range between any two of foregoing. Each recessed socket 62A-E has a configuration complementary to exposed engaging portion 48 of first magnets 40 so that engaging portions 48 can be received within a corresponding recessed socket 62A-E.

Receiving engaging portions 48 within recessed sockets 62 facilitates movable and removable engagement between appendages 14-18 and torso 12. That is, when an engaging portion 48 is received within a recessed socket 62 a combination of a light friction fit therebetween and the magnetic attraction between the first magnet 40 and corresponding second magnet 60 facilitates a secure but yet releasable engagement between the appendage and torso 12. As such, the assembled action character model 10 can be moved and played without unwanted separation between the appendage and torso 12. In the assembled configuration, opposing faces 42 and 44 of magnets 40 and 60 can be directly touching each other or be sufficiently close to achieve the desired magnetic attraction.

Depending on the size of the magnets used, the desired attachment can be achieved without producing any friction fit between engaging portion 48 and the recessed socket 62 in which it is received. As such the difference between the diameter of engaging portion 48 and recessed socket 62 can be greater than, equal to, or less than 0.1 mm, 0.5 mm, 1 mm, or 2 mm, or in a range between any two of foregoing. Other dimensions can also be used. Furthermore, because both engaging portion 48 and recessed socket 62 have complementary circular configurations, the appendage can be freely rotated on torso 12 by engaging portion 48 rotating within recessed socket 62. Where further mobility of the appendage is desired, the appendage can be formed with one or more joints thereof. For example, arms 14 could be formed with joints at the wrist, elbow and/or shoulder. Similar joints can also be formed on legs 16.

Figure 3:
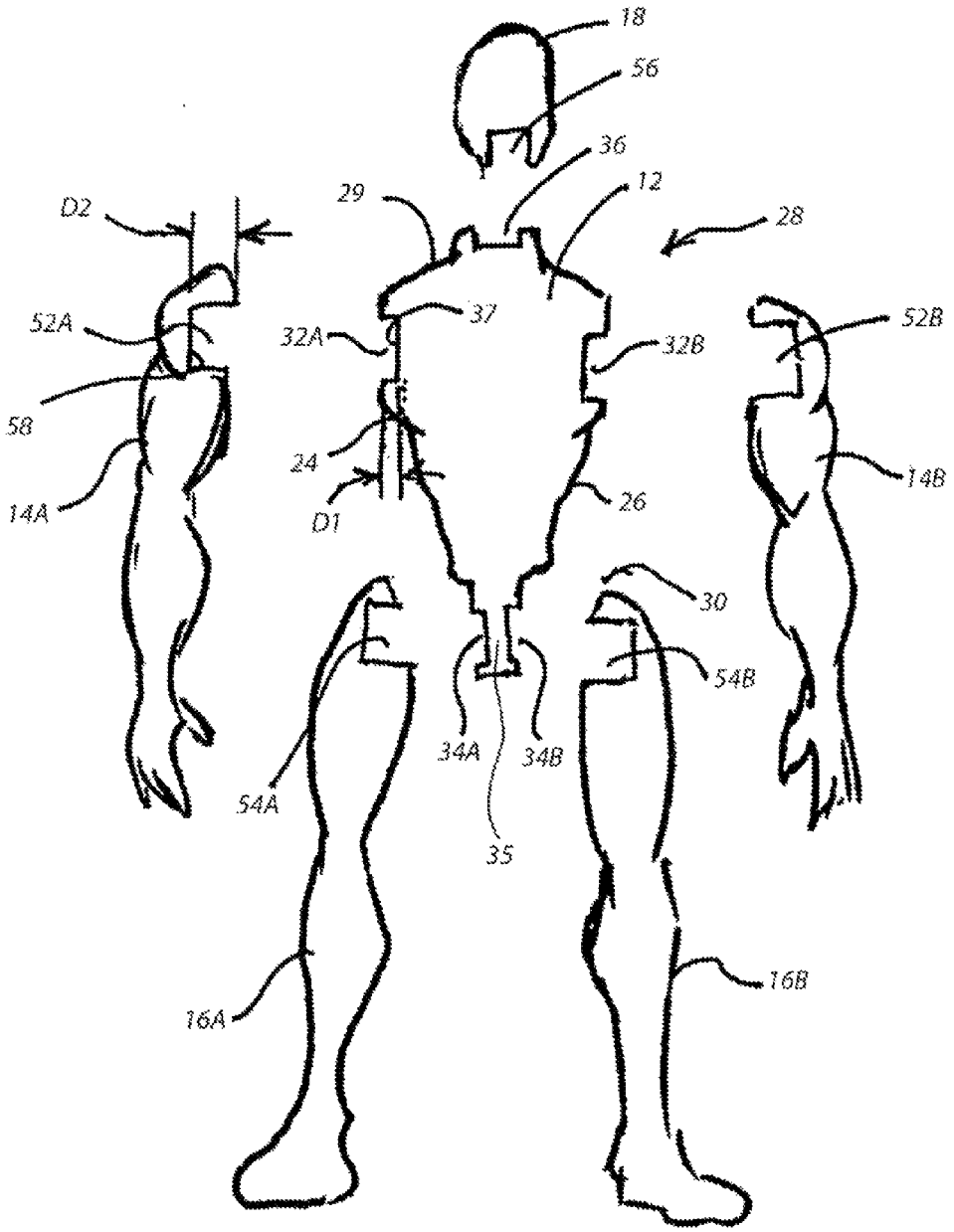
FIG. 3 is a partially cut away schematic view of the torso and appendages of the toy action character model shown in FIG. 1 showing openings thereon.

In the embodiment depicted, action character model 10 is formed so that engaging portions 48 are formed on torso 12 and recessed sockets 62 are formed on appendages 14, 16, and 18. This design provides some unique benefits. For example, as depicted in FIG. 3, at the lower end of torso 12 where legs 16A and 16B attach is a thin groin member 35 formed between openings 34A and 34B. Groin member 35 typically has a thickness between openings 34A and 34B that is greater than, equal to, or less than 0.1 cm, 0.3 cm, 0.5 cm, 0.7 cm, 1 cm or 1.5 cm or in a range between any two of foregoing. Other dimensions can also be used. Groin member 35 is thin so that action character model 10 is proportional when legs 16A and 16B are attached thereto. However, to maximize the thickness of groin member 35 for strength, shallow openings 34A and 34B are formed on opposing sides of groin member 35 as opposed to deeper openings 54A and 54B. That is, if openings 34A and 34B were replaced with openings 54A and 54B, respectively, so that engaging portions 48 were formed on legs 16A and 16B and recessed sockets 62 were formed on torso 12 (FIG. 5), groin member 35 could be so thin as to be structurally unstable or may even be too thin to accommodate openings 54A and 54B for a desired sized action character model 10. In alternative embodiments, however, such as where action character model 10 is larger, engaging portions 48 can be formed on appendages 14, 16, and 18 and recessed sockets 62 can be formed on torso 12.

Figure 12:
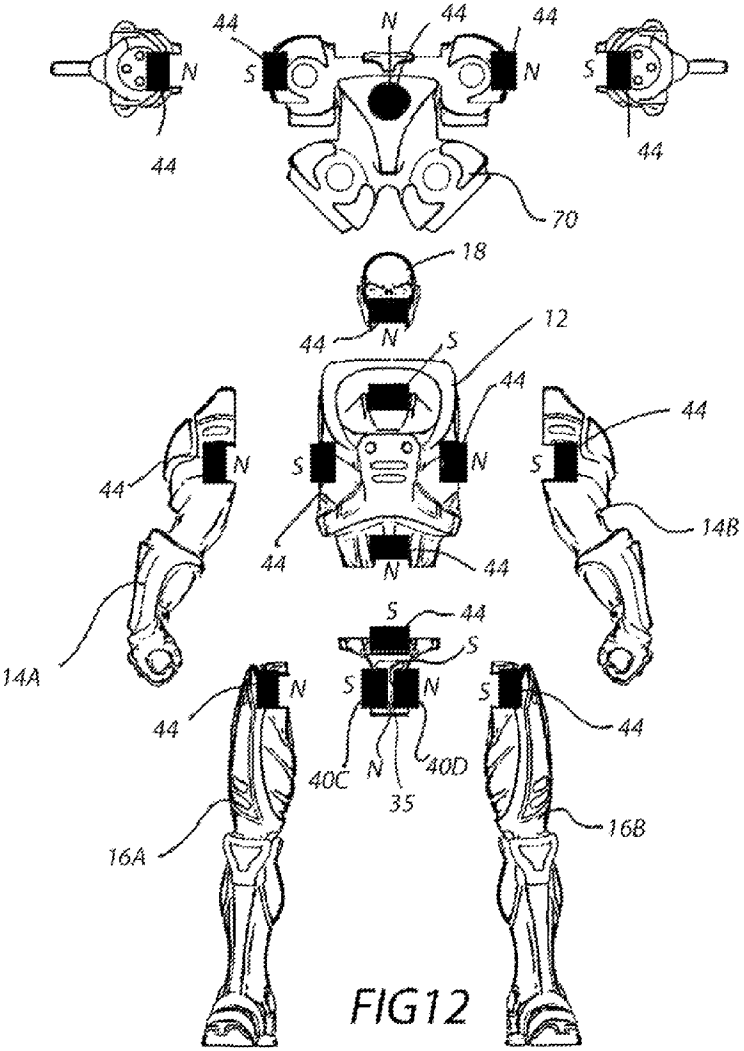
FIG. 12 is a partial cross sectional side view of the toy action character model shown in FIG. 1 showing the orientation of magnetic poles on the magnets.

The configuration of groin member 35 also influences the orientation of magnets 40 and 60. For example, because groin member 35 is so thin and the magnets have a strong pull force, magnets 40C and 40D are orientated, as depicted in FIG. 12, so that their adjacent opposing faces have opposite poles. As a result, the attraction of the magnets through groin member 35 assists to hold magnets 40C and 40D firmly against the opposing sides of groin member 35. In contrast, if the adjacent opposing faces of magnets 40C and 40D were the same poles, magnets 40C and 40D would repulse each other making it very difficult to secure magnets 40C and 40D to the opposing sides of groin member 35. Because the opposing inside faces of magnets 40C and 40D have opposite poles, the opposite outside faces of magnets 40C and 40D also have opposite poles. As a result, this dictates how magnets are orientated on legs 16A and 16B to facilitate magnetic attraction. For consistency in manufacture and assembly of parts, it can be beneficial that all of the magnets 40 on torso 12 form engaging portions 48.

Figure 6:
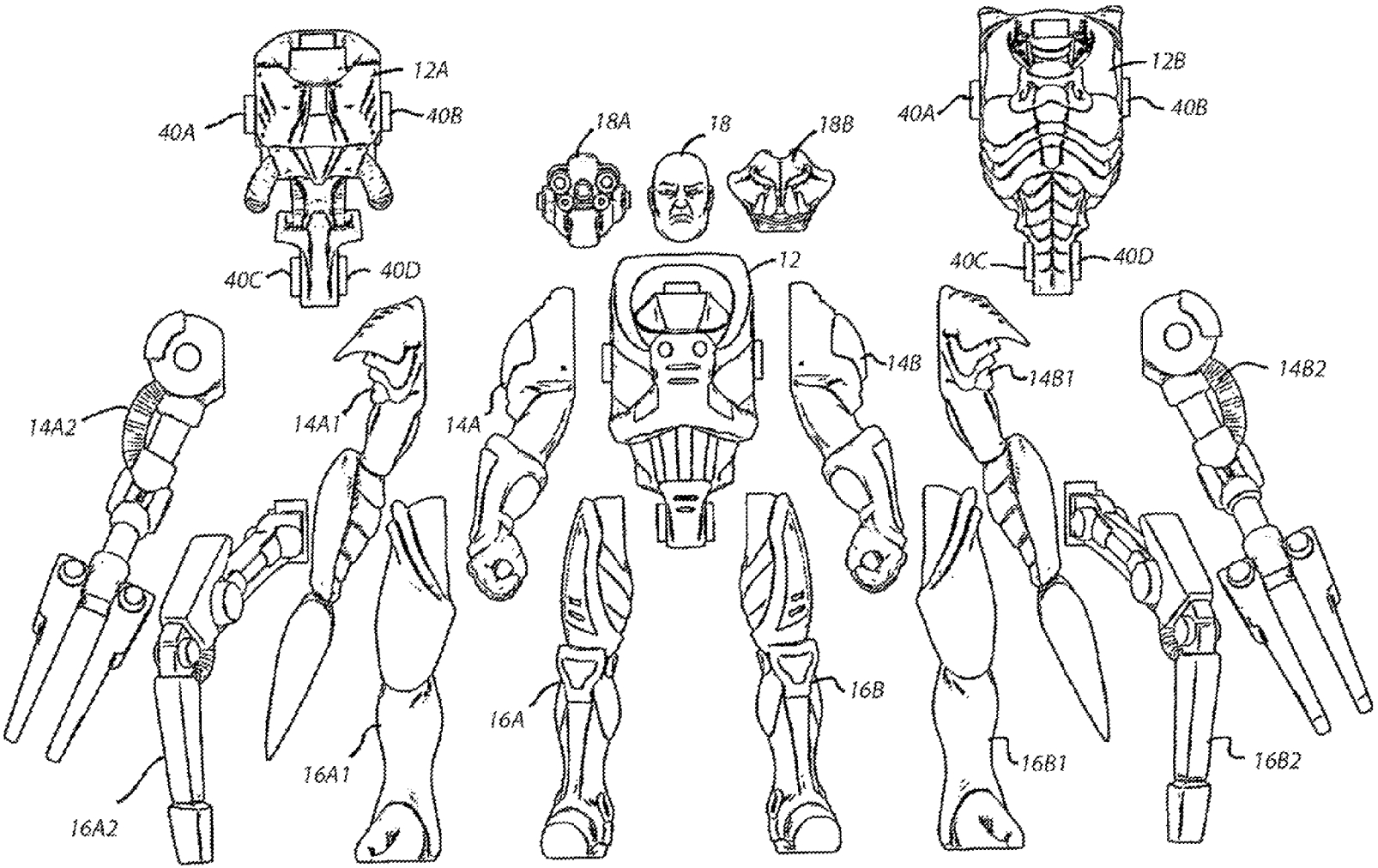
FIG. 6 is an exploded front elevational view the toy action character model shown in FIG. 1 with alternative torsos and appendages that can be used.
Figure 7:
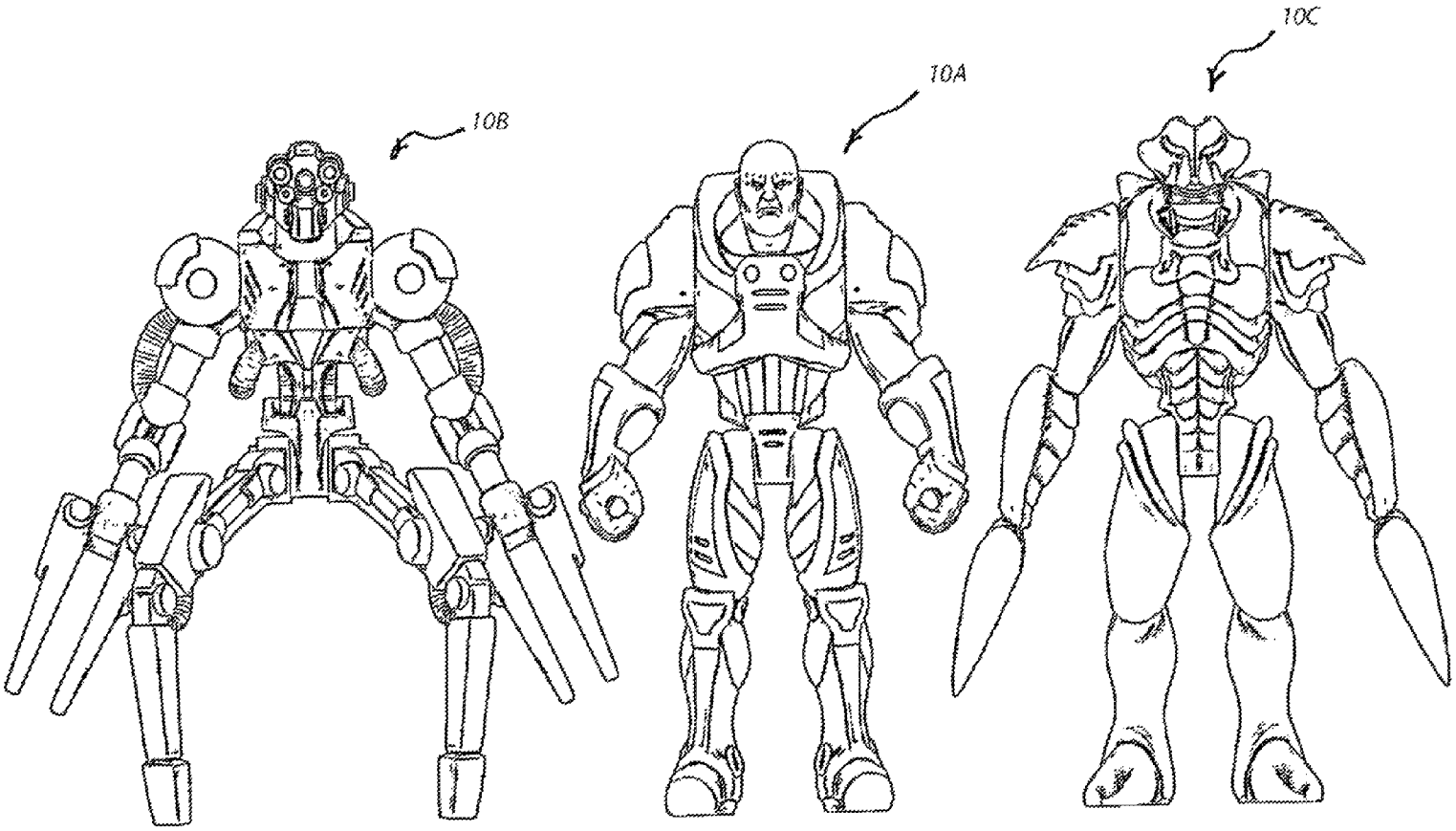
FIG. 7 is a front perspective view of alternative toy action character models that can be made from the parts shown in FIG. 6.

In alternative embodiments, however, such as where action character 10 is larger thereby resulting in groin member 35 being thicker and thus magnets 40C and 40D producing a less attractive or repulsive force on each other, magnets 40C and 40D could be orientated so that there opposing inside faces have the same pole. In turn, this would influence the orientation of the other magnets 40 and 60. As previously mentioned and as depicted in FIG. 6, torso 12 and each of appendages 14-18 can come in a variety of different configurations. For example, as depicted in FIG. 6, torso 12 can be replaced with torso 12A or 12B which also includes first magnets 40. Similarly, right arm 14A can be replaced within arm 14A1 or 14A2; left arm 14B can be replaced with within arm 14B1 or 14B2; right leg 16A can be replaced within leg 16A1 or 16A2; left leg 16B can be replaced with leg 16B1 or 16B2; and head 18 can be replaced with head 18A or 18B. All parts can be easily mixed and matched to form a variety of different action characters such as actions characters 10A, 10B, and 10C as shown in FIG. 7 or mixed combinations thereof. All appendages are easily removably attached using the magnet assembly as discussed above with regard to FIG. 5.

Figure 8:
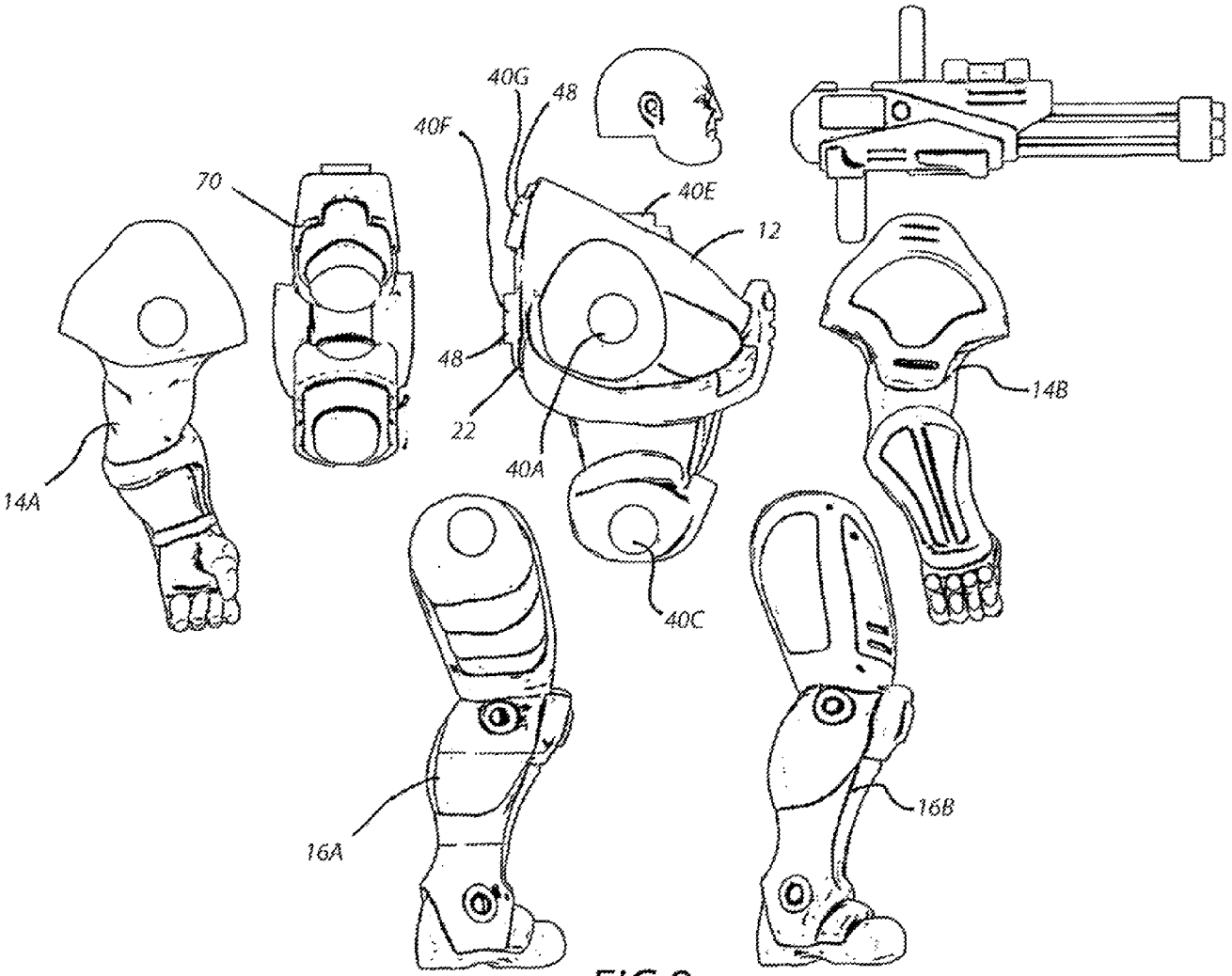
FIG. 8 is an exploded elevational side view of the toy action character model shown in FIG. 1.

Returning to FIG. 2, an accessory 70 such as a backpack, armament, shield, armor, clothing, or any other type of accessory can also be attached to torso 12 or any of appendages 14-18. Accessories 70 are attached to torso 12 or appendages 14-18 in the same way as discussed above that appendages 14-18 are attached to torso 12. For example, accessary 70 in FIG. 2 is shown having a cylindrical opening 74 formed thereon with a second magnet 60F secured therein so that a recessed socket 62F is formed on top thereof. In turn, as depicted in FIG. 8, first magnets 40F and 40G are secured on back surface 22 of torso 12 with the engaging portion 48 thereof outwardly projecting from torso 12 so that accessory 70 can be securely removably secured to torso 12 by one of engaging portions 48 of first magnets 40F or 40G being received within recessed socket 62F of accessory 70.

In alternative embodiments, as previously discussed, it is appreciated that the configuration of the mechanical/magnetic attachment between torso 12 and the appendages and accessories can be reversed. For example, rather than have engaging portions 48 of first magnets 40 outwardly projecting on torso 12, engaging portions 48 of first magnets 40 can be outwardly projecting on each of the appendages and accessories while second magnets 60 can be recessed on torso 12 with recessed sockets 62 formed above second magnets 60 to receive engaging portions 48 of first magnets 40.

Figure 9:
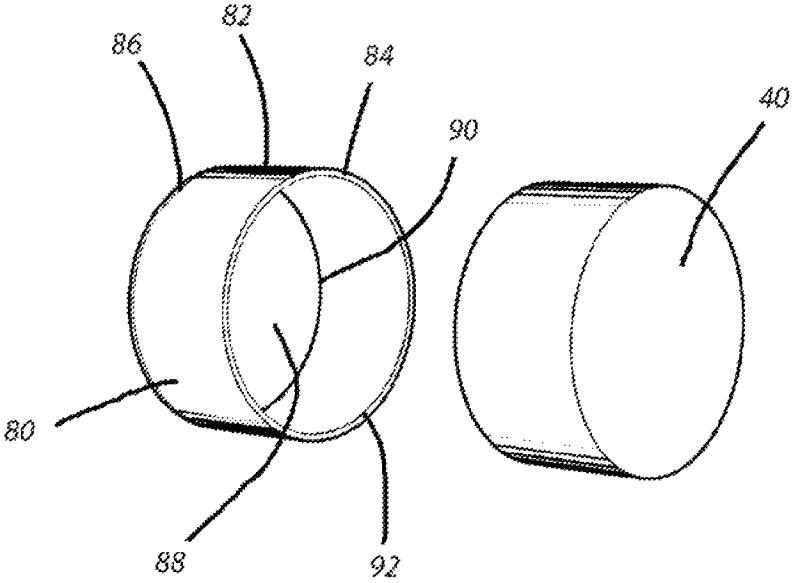
FIG. 9 is a perspective of a retainer that can be used in conjunction with a magnet of the toy action character model shown in FIG. 1.

As previously mentioned, torso 12, appendages 14, 16, and 18 and accessories 70 are typically made from a polymeric material. Examples of polymeric materials that can be used include polyethylene, polypropylene, polystyrene, polyvinylchloride (PVC), and acrylonitrile butadiene styrene (ABS). Other polymers can also be used. To assist in more firmly securing magnets 40, 60 to torso 12, appendages 14, 16, and 18 and/or accessories 70, so that magnets 40, 60 do not unintentionally separate therefrom, magnets can be at least partially enclosed or bounded by a retainer that is secured to torso 12, appendages 14, 16, and 18 and/or accessories 70. For example, depicted in FIG. 9 is one example of a retainer 80 in the form of a cap. Retainer 80 includes a cylindrical tubular sleeve 82 extending between a first end 84 and an opposing second end 86. Disposed at second end 86 of sleeve 82 is a circular end face 88. An interior surface of sleeve 82 and end face 88 bounds a pocket 90 that is cylindrical and at least generally complementary to magnet 40 so that magnet 40 can be received therein. An access opening 92 if formed at first end 84 of sleeve 82 through which magnet 40 can be positioned within pocket 90.

Figure 10:
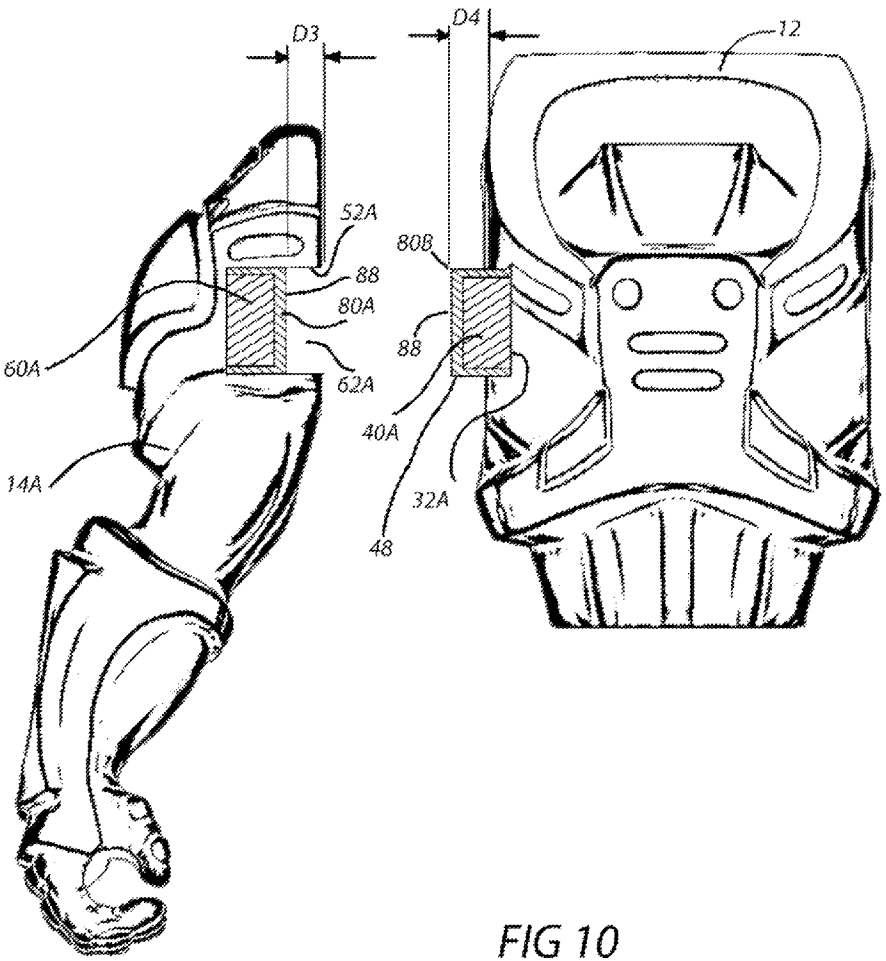
FIG. 10 is a partial cross sectional side view of the toy action character model using the retainers of FIG. 9 to retain the magnets.

During use magnet 40 or 60 is received within pocket 90 of retainer 80 and the combined magnet 40, 60 and retainer 80 are received within one of the openings on action character model 10. For example, as depicted in FIG. 10, a retainer 80A holding magnet 60A is received within opening 52A on arm 14A so that magnet 60A is captured between retainer 80A and arm 14A. Retainer 80A can be configured to form a loose or snug friction fit within opening 52A. Once retainer 80A is positioned within 52A, retainer 80A can be welded to arm 14A such as by sonic welding, heat welding, or other conventional welding techniques. Retainer 80A and the other retainers 80 discussed herein are also typically made of a polymeric material that is either the same as the material in which retainer 80 is being inserted, e.g., the material of arm 14A, or is made of a material that is compatible for welding with the material in which retainer 80 is being inserted so that when retainer 80A is welded to arm 14A, a strong bond is formed between retainer 80A and arm 14A to further prevent unwanted separation between magnet 60A and arm 14A. That is, a weld bond between compatible plastics will typically be greater than conventional bonds between a magnet and a plastic. In this configuration, recessed socket 62A is still formed extending from the exterior surface of arm 14A to end face 88 of retainer 80A. Recessed socket 62A can still have the same depths D3 as previously discussed.

In like manner, a retainer 80B can house magnet 40A and be received within opening 32A of torso 12 and welded to torso 12. Retainer 80B thus also assists in further securing magnet 40A to torso 12. As illustrated in FIG. 10, the combination of retainer 80B and magnet 40A still forms outwardly projecting engaging portion 48 that can be received within recessed socket 62A. The engaging portion 48 has a width $D_4$ that extends from the exterior surface of torso 12 to end face 88 and can have the same dimensions as $D_4$ previously discussed. To account for the use of retainers 80, the diameter and/or depth of the various openings on can be increased on torso 12, appendages 14, 16, and 18 and accessories 70. Retainers 80 typically have a thickness at sleeve 82 and end face 88 greater than, equal to, or less than 1 mm, 1.5 mm, 2 mm, or 2.5 mm, or in a range between any two of foregoing. Other dimensions can also be used.

Figure 11B:
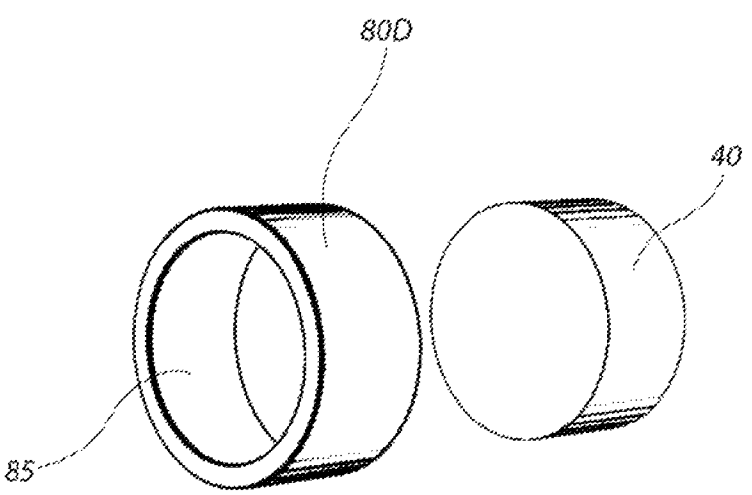
FIGS. 11A and 11B are perspective views of alternative embodiments of the retainer shown in FIG. 9.
Figure 11A:
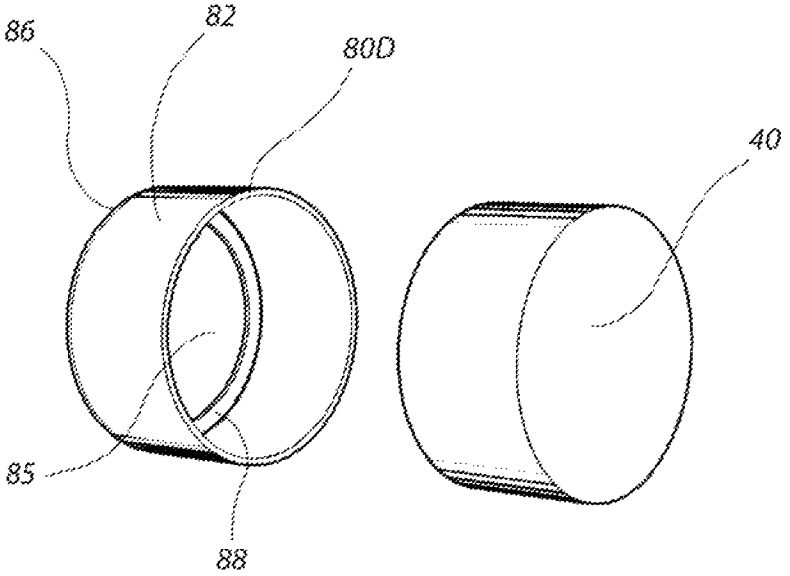

As before, with engaging portion 48 received within recessed socket 62A a magnetic coupling is formed between magnets 40 and 60 while engaging portion 48 can rotate within recessed socket 62A. Here it is noted that magnets 40 and 60 need not be cylindrical but could have other transverse cross sectional areas such as polygonal, oval, irregular or others as long as recessed socket 62A and the exposed engaging portion 48 have configuration that permits the exposed engaging portion 48 to rotate within recessed socket 62A. Likewise, retainers 80 need not cover all of magnets 40 and 60. That is, multiple holes could be formed through retainers 80 as long as there is sufficient structure to securely retainer magnets 40 and 60. For example, depicted in FIGS. 11A and 11B is a retainer 80E. Like elements between retainers 80 and 80E are identified by like reference characters. Retainers 80 and 80E are the same except that a hole 85 is formed through end face 88 so that all that remains of end face 88 is an inwardly projecting flange 87. Flange 87 prevents magnet 40 from passing through retainer 80E.

Figure 11C:
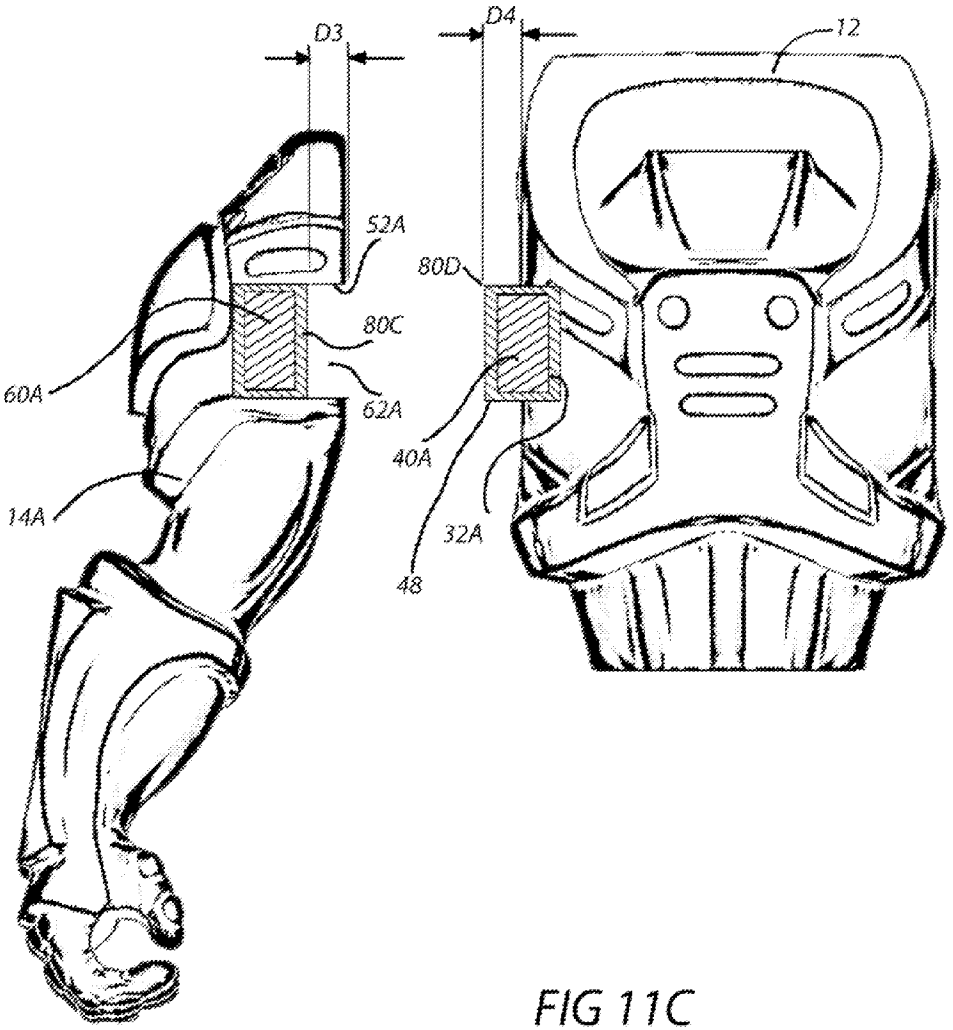
FIG. 11C is a partial cross sectional side view of the toy action character model using alternative retainers to retain the magnets.

In contrast to retainers 80 forming an open cap that receives magnets 40, 60, as discussed above, retainers 80 can also form an enclosure that completely encircles magnet 40, 60. For example, as depicted in FIG. 11C, a retainer 80C is shown having cylindrical configuration that completely encircles magnet 60A and is received in opening 52A of arm 14A while a retainer 80D having the same configuration as retainer 80C completely encircles magnet 40A and is received within opening 32A on torso 12. Again, retainers 80C and 80D can be comprised of a plastic material and welded to arm 14A and torso 12. Other configurations of retainers 80 can also be used. For examples, retainer 80 could comprise plates, plugs, sheets, or other configurations that can be welded to torso 12, appendages 14, 16, and 18 and/or accessories 70 for securing magnets 40, 60. In still other embodiments, magnets 40, 60 can be over molded on torso 12, appendages 14, 16, and 18 and/or accessories 70. In that embodiment, the portion of the over molding cover magnets 40, 60 can be considered the retainer.

In like manner to the above, retainers 80 can also be used for securing magnets 40 and 60 within each of the other openings on torso 12, appendages 14, 16, and 18 and/or accessories 70. In addition, when retainers 80 are used, engaging portion 48 on torso 12 can be switched with recessed socket 62A on appendages 14, 16, and 18 and/or accessories 70.

The foregoing assembly for the toy action character model has a number of unique advantages. For example, the assembly makes it easy to attach, remove, and switch appendages and accessories from the torso to make multiple difference characters. The appendages and accessories attached to the torso can be easily and smooth moved for manipulating the character without unwanted separation of the parts. Furthermore, manufacture of the torso, appendages and accessories is simple and the resulting product is sturdy with no delicate parts that are easily broken. Other advantages also exist.

As previously discussed, to facilitate magnet coupling between adjacent magnets 40 and 60, the opposing faces on adjacent magnets 40 and 60 are positioned to have opposite poles. For example, FIG. 12 depicts action character model 10 in a partially exploded view where the poles of opposing faces of magnets 40 and 60 are shown as having either a north pole ("N") or a south pole ("S"). In an alternative embodiment, the designated poles could be reversed.

Figures 13, 14:
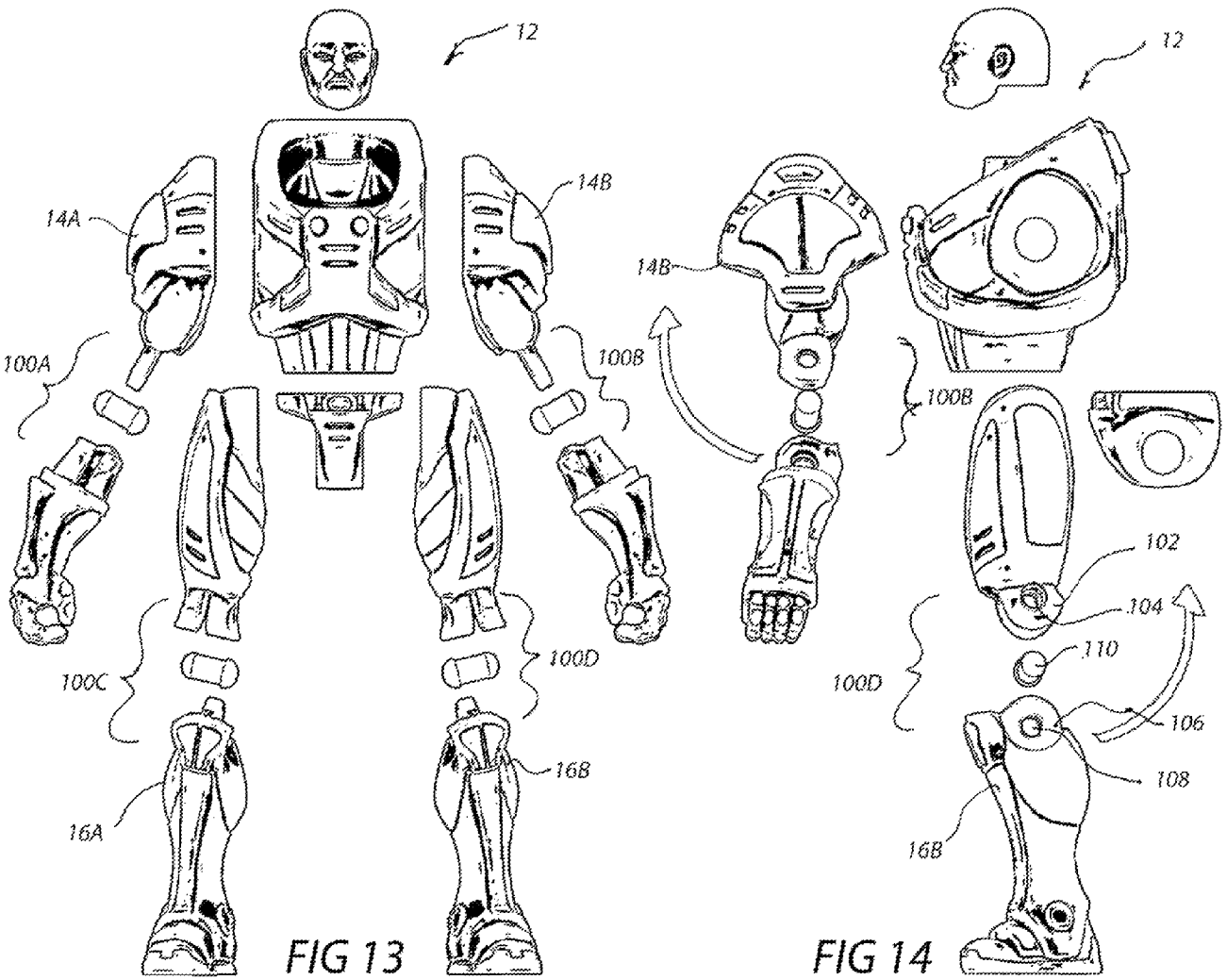
FIG. 13 is a partially exploded front elevational view of the toy action character model shown in FIG. 1 showing hinged knees and elbows.
FIG. 14 is a partially exploded side elevational view of the toy action character model shown in FIG. 13.

In other embodiments as also previously discussed, action character model 10 can be made with one or more hinge joints. For example, as depicted in FIGS. 13 and 14, arms 14A and 14B and legs 16A and 16B are each formed with a hinge 100A-110D, respectively. Each hinge 100 comprises a rounded first knuckle 102 disposed on an upper portion of an arm 14 or leg 16 and having a passage 104 extending therethrough. Each hinge 100 also includes a second knuckle 106 disposed on a lower portion of the corresponding arm 14 or leg 16 and having a passage 108 extending therethrough. In one embodiment, one of knuckles 102 and 106 can be forked so that the other knuckle can be received therebetween. During assembly, knuckles 102 and 106 are placed together so that passages 104 and 108 are aligned. A hinge pin 110 is then received and secured within aligned passages 104 and 108 so that knuckles 102 and 106 and thus the corresponding upper and lower portions of arms 14 and legs 16 are hingedly coupled together. Other forms of hinges can also be used and hinges can also be places at other locations such as at the wrist, elbow, shoulder, neck, stomach, waits, hip, knee, ankle or the like.

As previously discussed, action character model 10 can come in an infinite number of different configurations and can be used with an infinite number of replaceable parts having different configurations. An "action character model" or "toy action character model" as used herein references a model of an action character that is depicted as living. In contrast, an "action character accessory" or "toy action character accessory" as used herein references an object that is depicted as inanimate and may or may not be used by an action character model but which is separate from an action character model. Examples of action character accessories include, but are not limited to, vehicles; such as, spaceships, aircraft, ground vehicles, and water vehicles; weapons; equipment; armor; buildings; clothing; structures and the like. An "action character assembly" or "toy action character assembly" as used herein references both action character models and action character accessories.

Figure 15:
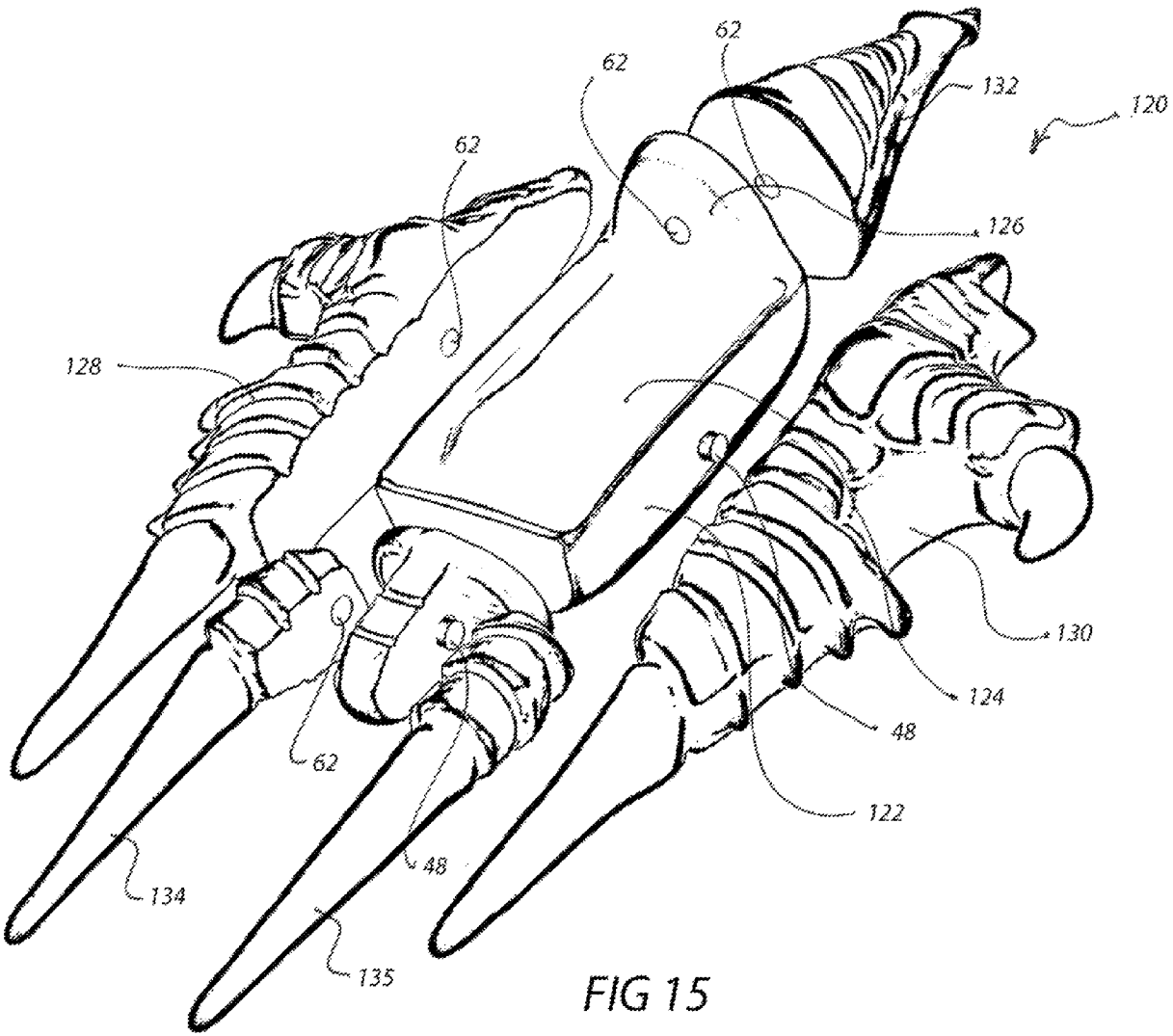
FIG. 15 is a partially exploded perspective view of a toy action character accessory.
Figure 17:
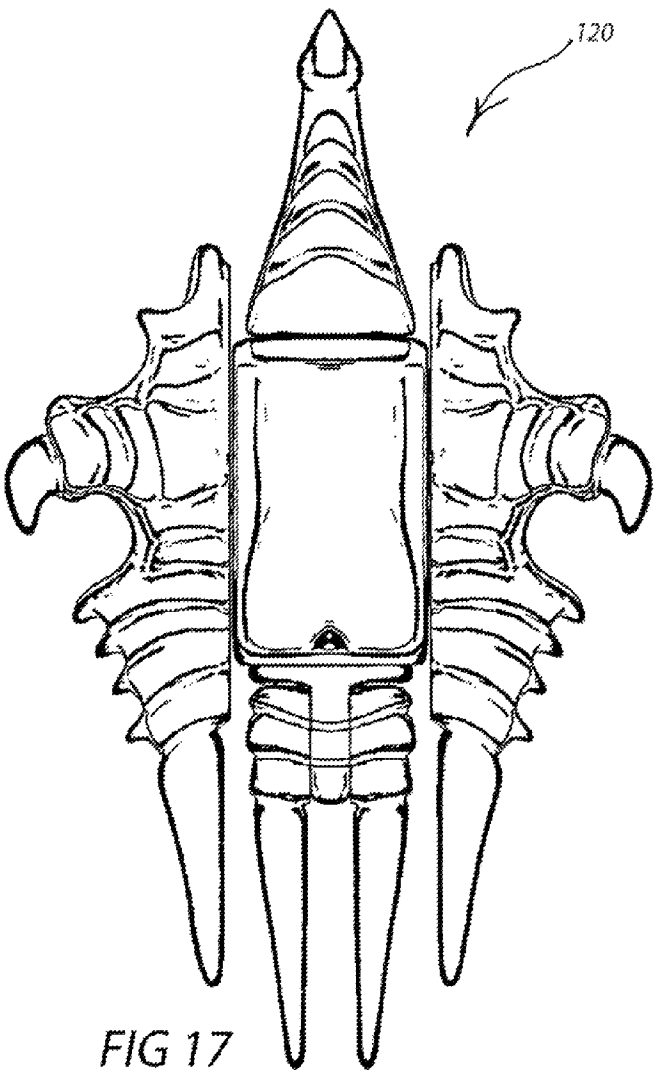
FIG. 17 is top plan view of the assembled toy action character accessory shown in FIG. 15.
Figure 16:
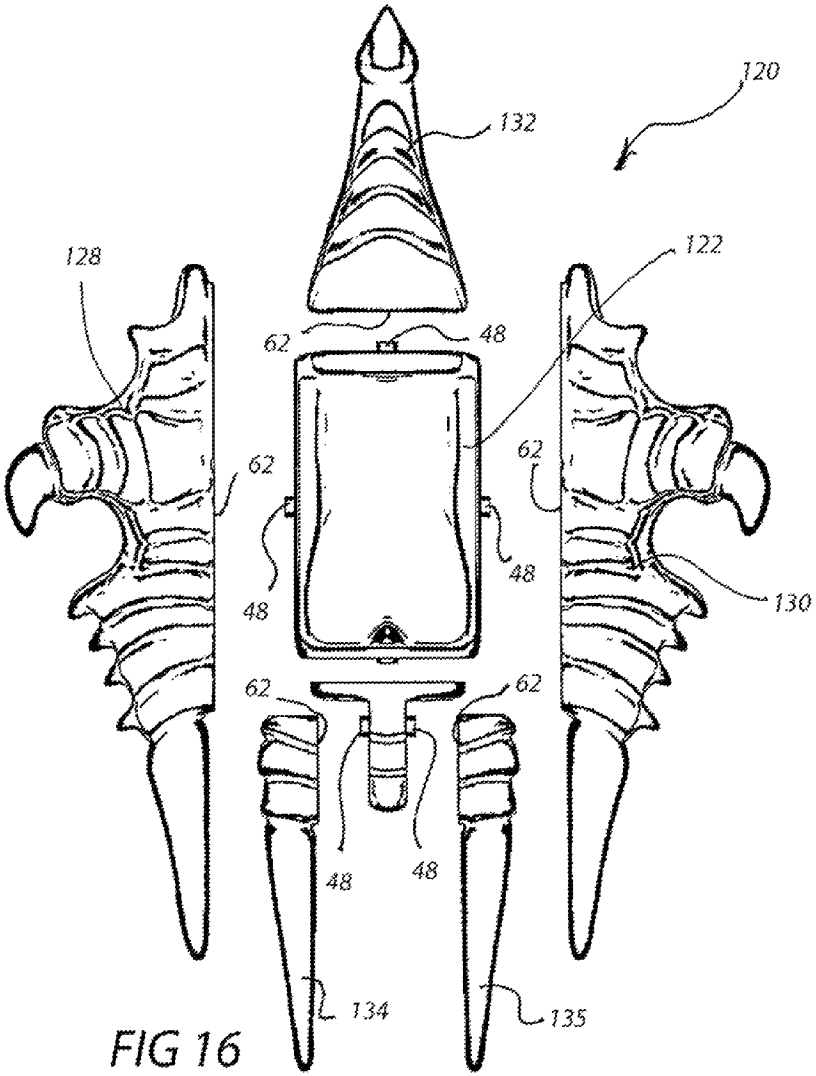
FIG. 16 is a partially exploded top plan view of the toy action character accessory shown in FIG. 15.

Depicted in FIGS. 15-17 is one embodiment of an action character accessory 120 which is in the form of an aircraft that could be ridden by action character model 10. Like elements between action character model 10 and action character accessory 120 are identified by like reference characters. A depicted in the figures, action character assembly 120 comprises a body 122 having a seat 124 and a back rest 126. Disposed on opposing sides of body 122 are wings 128 and 130. A tail 132 attaches to a rear end of body 122 while a pair of guns 134 and 135 project from a front end of body 122. Wings 128 and 130, tail 132, and guns 134 and 135 are attached to body 122 using engaging portions 48 that project from body 122 and recessed sockets 62 formed on wings 128, 130, tail 132, and guns 134 and 135 which received engaging portions 48.

More specifically, engaging portions 48 project from body 120 and comprise either a magnet 40 or the combination of a magnet 40 and retainer 80, as previously discussed with regard to action character model 10. Likewise, a magnet 60 is disposed within each of wings 128 and 130, tail 132, and guns 134 and 135 so as to be adjacent to recessed sockets 62. As previously discussed, a retainer 80 can be used to secure magnet 60 adjacent to recessed socket 62. Accordingly, when engaging portions 48 are received within recessed sockets 62, a magnetic coupling and an optional lite friction fit engagement is produced so as to secure wings 128, 130, tail 132, and guns 134 and 135 to body 122 but still enables wings 128, 130, tail 132, and guns 134 and 135 to independently rotate relative to body 122. All the previously discussions, dimensions, alternatives, workings and operation discussed or relating to openings for receiving magnets 40, 60, engaging portions 48, magnets 40, 60, recessed sockets 62, and retainers 80 discussed with regard to action character model 10 are also applicable to action character accessory 120.

It is appreciated that any number of different engaging portions 48 and recess socket 62 with corresponding magnets 40, 60 can be formed on action character accessory 120 and that any number of different parts of different configurations can be exchanged. As with action character model 10, the different parts of action character accessory 120 are typically made of a polymer to which retainers 80 can be welded.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An action character model comprising:

a torso;

a plurality of appendages comprising a head and at least one arm and one leg;

a plurality of first discs, each first disc being comprised of a metal and being attached to and projecting outside of one of the torso or the plurality of appendages; and a plurality of second discs disposed within the other of the torso or the plurality of appendages on which the first discs are not attached, each second disc comprising a disc magnet, at least a portion of the disc magnet being disposed directly against the other of the torso or the plurality of appendages, the other of the torso or plurality of appendages each bounding a recessed socket extending from an exterior surface of the corresponding torso or appendage toward a corresponding one of the second discs, each of the first discs being at least partially received within a corresponding recessed socket so that each appendage is magnetically coupled with the torso and so that each appendage is rotatable on the torso.

2. The toy action character model as recited in claim 1, wherein each first disc has a cylindrical configuration and each recessed socket is bounded by an interior side surface having a cylindrical configuration.

3. The toy action character model as recited in claim 1, wherein the plurality of appendages comprise the head, two arms and two legs.

4. The toy action character model as recited in claim 1, further comprising accessories removably attached to the torso or appendages.

5. The toy action character model as recited in claim 1, wherein each recessed socket has a depth in a range between 0.1 cm and 0.5 cm.

6. The toy action character model as recited in claim 1, wherein the first discs are partially disposed within openings formed on the one of the torso or the plurality of appendages.

7. The toy action character model as recited in claim 1, wherein the first discs are disc magnets.

8. The toy action character model as recited in claim 1, further comprising:

the torso and each of the plurality of appendages being comprised of a polymer; and a plurality of retainers, each retainer being welded to the one of the torso or the plurality of appendages so that each first disc is captured between the one of the torso or the plurality of appendages and at least part of a corresponding one of the plurality of retainers.

9. The toy action character model as recited in claim 8, wherein each retainer comprises a cap having a pocket in which a corresponding first disc is received.

10. The toy action character model as recited in claim 1, wherein each second disc has a first end face, and opposing second end face, and a circular sidewall extending therebetween, the circular sidewall of each second disc being disposed directly against the other of the torso or the plurality of appendages.

11. The toy action character model as recited in claim 10, wherein the second discs are fully disposed within openings formed on the other of the torso or the plurality of appendages, the first end face of each second disc being openly exposed to the recessed socket and the second end face of each second disc being disposed directly against the other of the torso or the plurality of appendages.

12. The toy action character model as recited in claim 11, wherein the openings on the other of the torso or the plurality of appendages are cylindrical.

13. The toy action character model as recited in claim 1, wherein each first disc has a circular sidewall, at least a portion of the circular sidewall of each first disc being disposed within the recessed socket directly adjacent to the other of the torso or the plurality of appendages.

14. A toy action character assembly comprising:

a first part comprised of a polymer;

a first disc attached to the first part and being comprised of a metal, the first disc having a circular sidewall that extends to an end face, at least a portion of the circular sidewall being spaced apart from the first part;

a second part comprised of a polymer and having an exterior surface; and a second disc disposed within the second part and comprising a disc magnet, wherein a first recessed socket is formed on the second part and extends from the exterior surface of the second part toward the second disc, at least a portion of the first disc being received within the first recessed socket of the second part so that the first disc is magnetically coupled to the second disc and the at least a portion of the circular sidewall of the first disc is disposed directly against the second part, the first disc being rotatable within the first recessed socket.

15. The toy action character assembly as recited in claim 14, wherein the first disc and the second disc each comprise a cylindrical disc magnet.

16. The toy action character assembly as recited in claim 14, wherein the first disc is partially disposed within an opening formed on the first part.

17. The toy action character assembly as recited in claim 14, wherein the first recessed socket has a depth in a range between 0.1 cm and 0.5 cm and the at least a portion of the circular sidewall of the first disc has a length in a range between 0.1 cm and 0.5 cm.

18. The toy action character assembly as recited in claim 14, wherein the toy action character assembly comprises a toy action character model or a toy action character accessory.

19. The toy action character assembly as recited in claim 18, wherein the toy action character assembly comprises a toy action character accessory selected from the group consisting of a vehicle, weapon, equipment, armor or clothing.

20. The toy action character assembly as recited in claim 14, further comprising a third disc attached to the first part and being comprised of metal, the third disc having an engaging portion projecting away from the first part;

a third part comprised of a polymer and having an exterior surface; and a fourth disc disposed within the third part and comprising a magnetic disc, wherein a second recessed socket is formed on the third part and extends from the exterior surface of the third part toward the fourth disc, at least a portion of the engaging portion of the third disc being received within the second recessed socket of the third part so that the first part is magnetically coupled to the third part by the third disc and the fourth disc and so that the engaging portion of the third disc can rotate within the second recessed socket.

21. The toy action character assembly as recited in claim 14, wherein the second disc has a pull force of at least 1.4 kilograms.

* * * * *